US007389857B2

(12) United States Patent
Hikita

(10) Patent No.: US 7,389,857 B2
(45) Date of Patent: Jun. 24, 2008

(54) ELEVATOR GROUP CONTROL SYSTEM

(75) Inventor: Shiro Hikita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 547 days.

(21) Appl. No.: 10/545,008

(22) PCT Filed: Mar. 26, 2004

(86) PCT No.: PCT/JP2004/004300

§ 371 (c)(1),
(2), (4) Date: Aug. 10, 2005

(87) PCT Pub. No.: WO2005/092762

PCT Pub. Date: Oct. 6, 2005

(65) Prior Publication Data

US 2006/0175146 A1 Aug. 10, 2006

(51) Int. Cl.
*B66B 9/00* (2006.01)

(52) U.S. Cl. ..... 187/249; 187/382

(58) Field of Classification Search ..... 187/249, 187/380–388, 354, 902

See application file for complete search history.

(56) References Cited

U.S. PATENT DOCUMENTS

| | | | | |
|---|---|---|---|---|
| 5,419,414 | A * | 5/1995 | Sakita | 187/391 |
| 5,663,538 | A * | 9/1997 | Sakita | 187/382 |
| 5,877,462 | A * | 3/1999 | Chenais | 187/249 |
| 6,273,217 | B1 | 8/2001 | Hikita | |
| 6,360,849 | B1 * | 3/2002 | Hikita | 187/381 |
| 6,364,065 | B1 * | 4/2002 | Hikita | 187/382 |
| 6,871,727 | B2 * | 3/2005 | Jokela et al. | 187/383 |
| 7,032,716 | B2 * | 4/2006 | Meyle et al. | 187/382 |

FOREIGN PATENT DOCUMENTS

| | | |
|---|---|---|
| JP | 06-305648 | 11/1994 |
| JP | 2000-226164 | 8/2000 |
| JP | 2001-048431 | 2/2001 |
| JP | 2001-130843 | 5/2001 |
| JP | 2001-335244 | 12/2001 |
| JP | 2002-220164 | 8/2002 |
| JP | 2003-081542 | 3/2003 |

OTHER PUBLICATIONS

Atsuya Fujino et al., "Basis Study on Mass Transportation Systems in Building by Means of Multiple-cage Elevators", T.IEE Japan, vol. 117-D, No. 9, '97, pp. 815-822.

* cited by examiner

*Primary Examiner*—Jonathan Salata
(74) *Attorney, Agent, or Firm*—Leydig, Voit & Mayer, Ltd.

(57) ABSTRACT

An elevator group control apparatus to control an elevator system in which an upper car and a lower car serve in a single shaft and go up and down independently. If a new destination call is registered, a car travel range calculator provisionally assigns a car to the new destination call and calculates the travel range of the provisionally assigned car and the travel range of the other car in the same shaft. Based on the calculated travel ranges, an assignment candidate selector selects or rejects the car as a candidate for assignment to the new destination call. Later, several evaluation index values are calculated for each of the selected candidate cars. By comprehensively evaluating these calculated evaluation index values, a determination is made as to which car is to be assigned to the new destination call.

6 Claims, 4 Drawing Sheets

ELEVATOR GROUP CONTROL SYSTEM

TECHNICAL FIELD

The present invention relates to an elevator group control-apparatus for efficiently controlling the same bank of plural elevators in an elevator system with two cars serving in one shaft.

BACKGROUND ART

To control a bank of elevators, a group control apparatus is typically used to efficiently run these elevators. In some elevator systems, a plurality of cars serve in a single shaft. Different from an elevator system where only a single car serves in each shaft, such an elevator system requires its group control apparatus to not only raise the transportation efficiency but also avoid collision between them. An example of such a prior art group control apparatus is an operation control apparatus employed in a multi-car elevator system as described in Japanese Patent No. 3029168. This operation control apparatus always checks the current position of the front car and the stoppable position of the rear car and, if the stoppable position of the rear car enters a zone of a certain length assumed behind the front car, this apparatus controls to stop the rear car. Although it is therefore possible to avoid collision between the cars, the rear car must be stopped to prevent collision. In addition, since this operation control apparatus assumes application to a circulation-type elevator system including an up-only shaft and a down-only shaft, it is not possible to lift up and down each car independently, making it difficult to raise the transportation efficiency as an elevator system.

In the case of an elevator group control apparatus disclosed in Japanese Patent Laid-Open No. 2001-335244, if a new destination floor is entered, the elevator group control apparatus computes the expected positional transition of a car at a desired time taken until the desired car reaches the destination floor inputted and those of the other cars in the same shaft and predicts whether the car would collide with another car before it reaches the destination floor. Based on the result of such predictions, the elevator group control apparatus determines which car is to be assigned to the new destination floor call. However, since this assignment is determined based on predictions subject to calculation errors, etc., there remains a possibility that the car assigned to the new destination floor call may collide with another car. Therefore, to avoid collision between cars, emergency stop is required. This makes it difficult to improve the operation efficiency.

The present invention solves the above-described conventional problems with an elevator system having two cars capable of going up and down independently in each shaft. Control according to the present invention can reliably avoid collision between cars serving in the same shaft while efficiently operating the same bank of plural elevators.

DISCLOSURE OF THE INVENTION

According to the present invention, there is provided an elevator group control apparatus for controlling an elevator system where an upper car and a lower car can go up and down independently in each shaft, wherein each car is provisionally assigned to a new destination call and selected or not selected as an assignment candidate car based on its travel range and wherein of the other car in the same shaft and of the thus selected assignment candidate cars, the optimum car is assigned to the new destination call.

BEST MODE FOR CARRYING OUT THE INVENTION

The present invention will be described below in detail along with the attached drawings.

Figure 1:
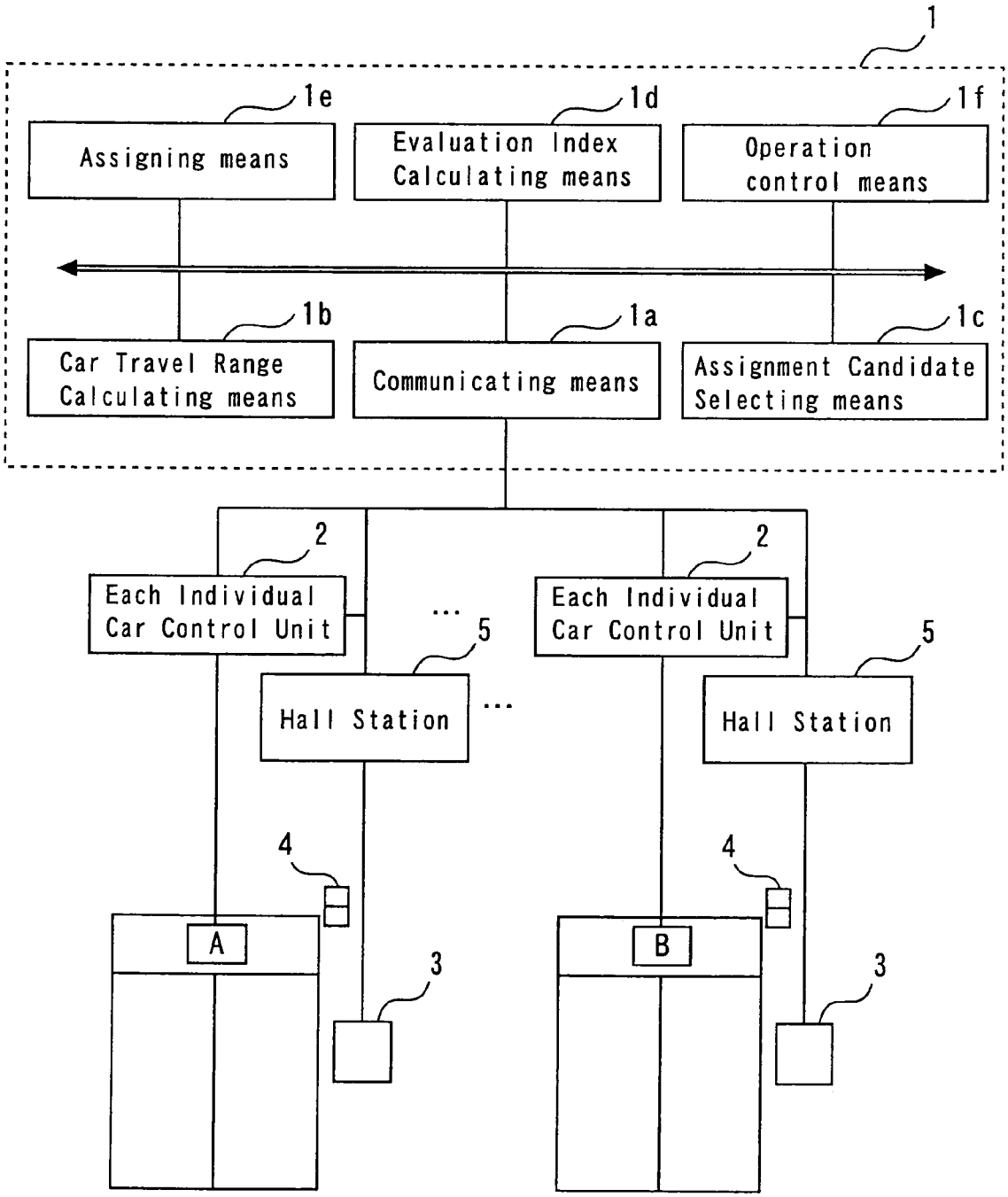
FIG. 1 is a block diagram showing the configuration of an elevator system provided with a group control apparatus in accordance with the present invention.
Figure 2:
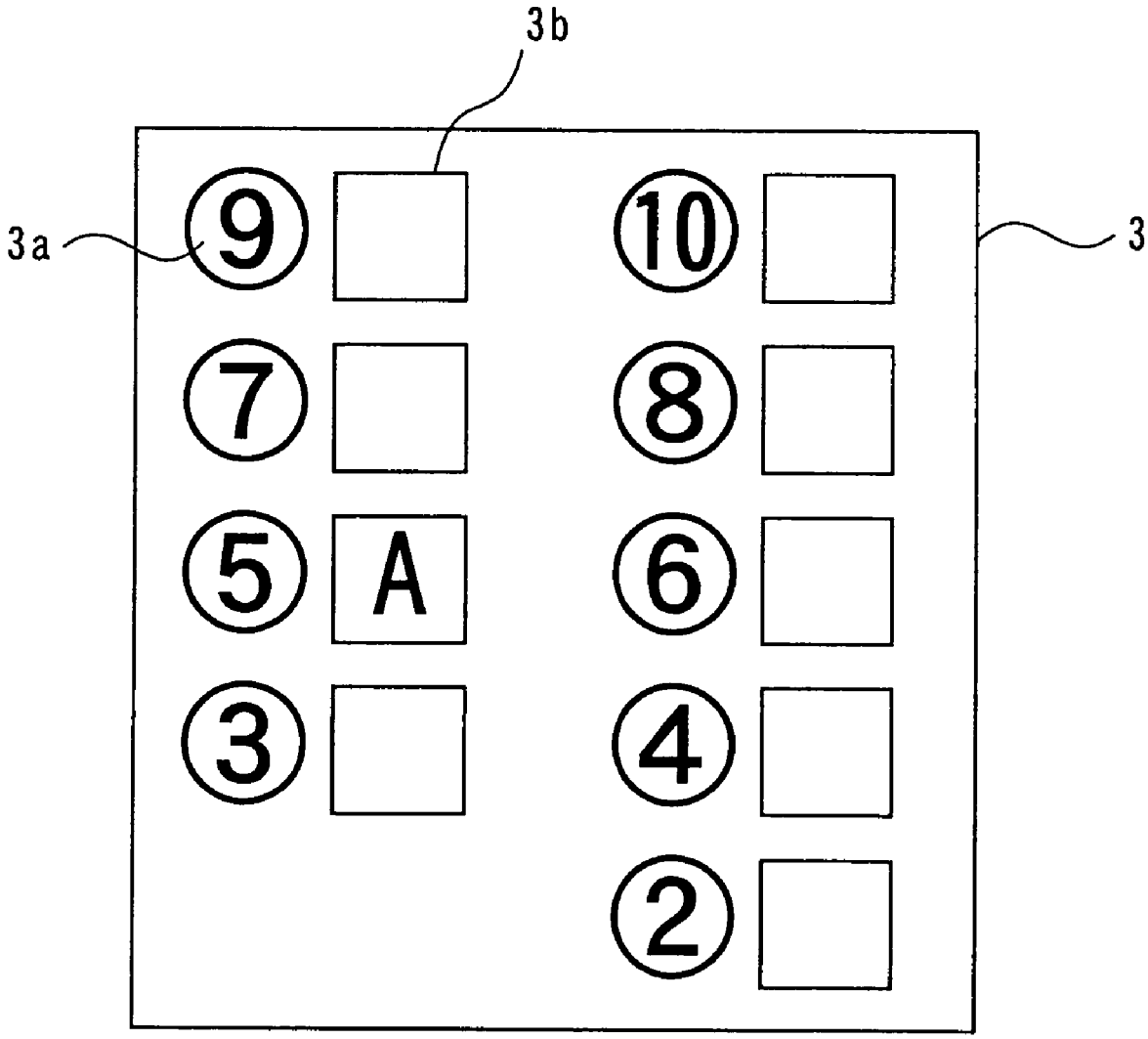
FIG. 2 schematically shows a destination floor registration device placed at the elevator halls in accordance with the present invention.
Figure 3:
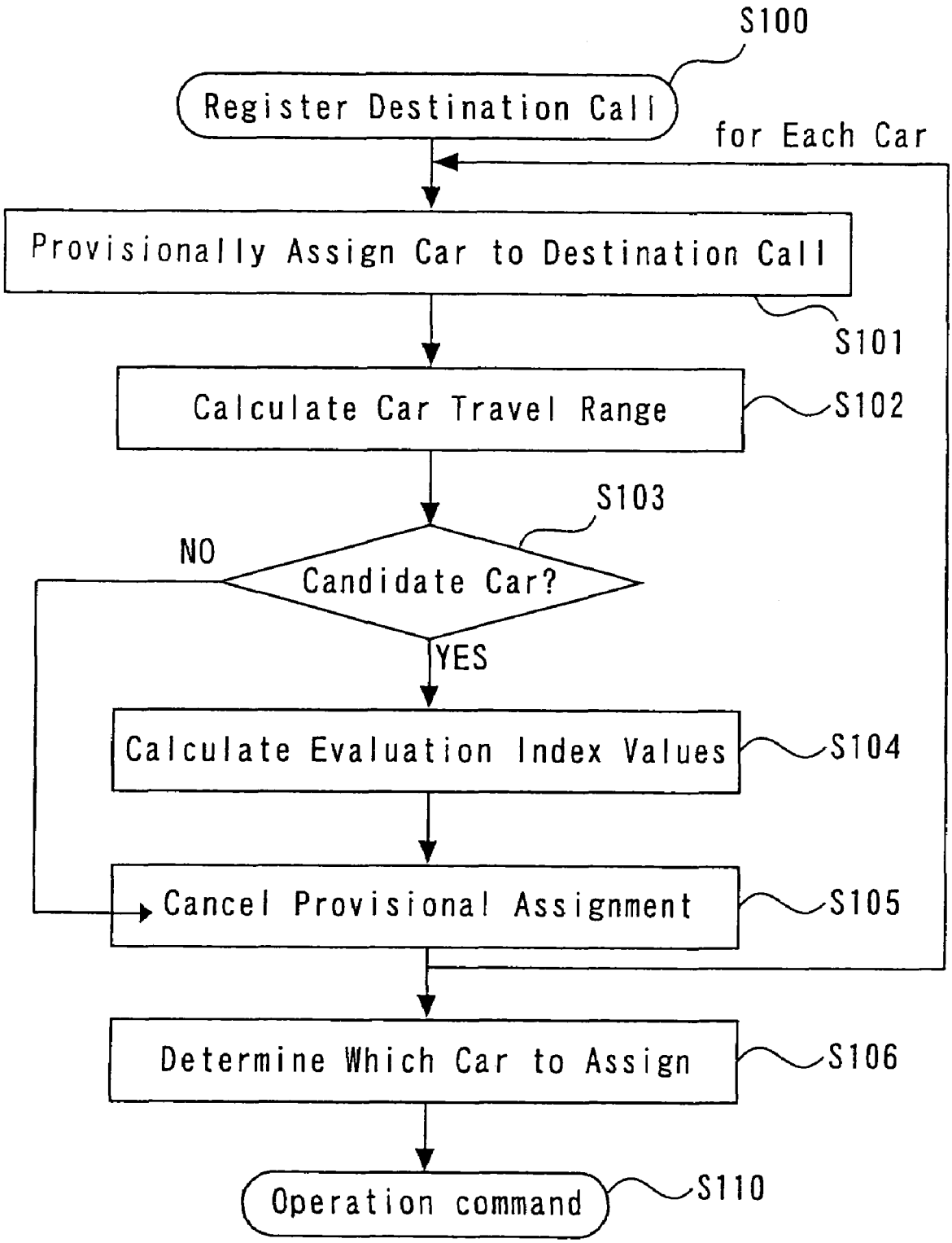
FIG. 3 is a flowchart showing flows of control by the elevator group control apparatus of the present invention.
Figure 4A:
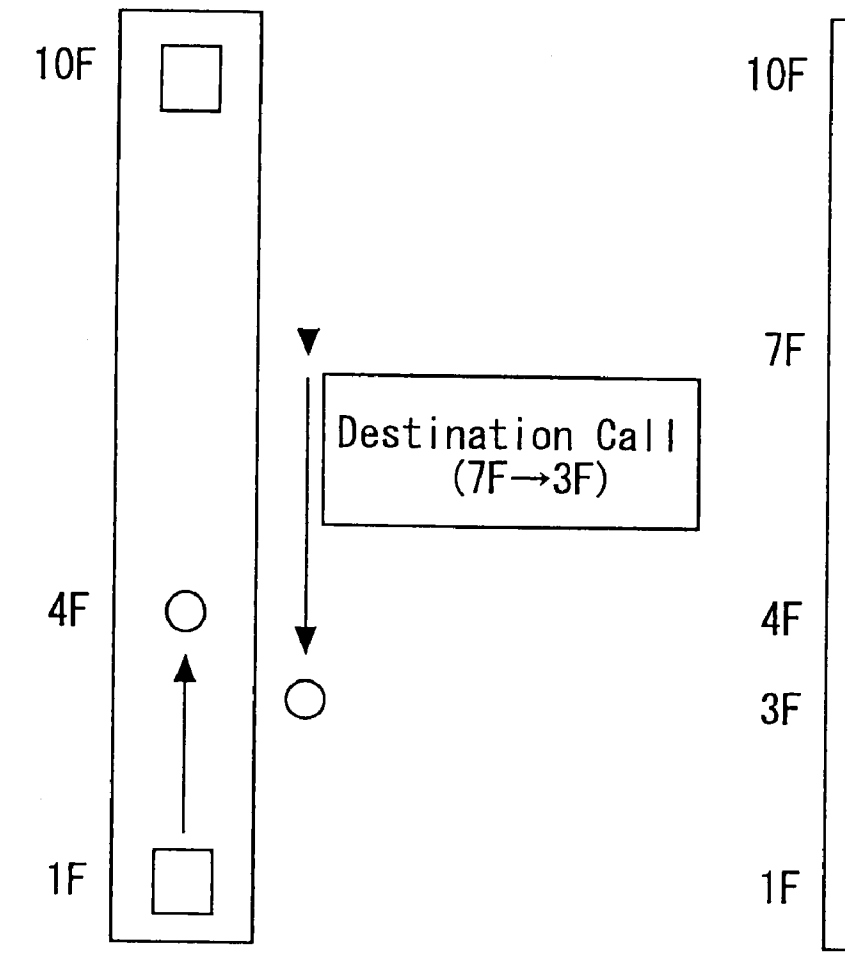
FIGS. 4(*a*)-(*c*), explain how the elevator group control apparatus of the present invention calculates the travel ranges of cars and determines candidate cars.
Figure 4B:
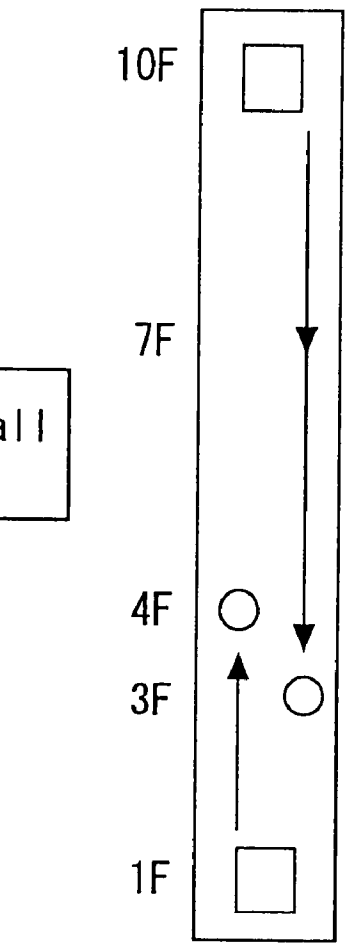
Figure 4C:
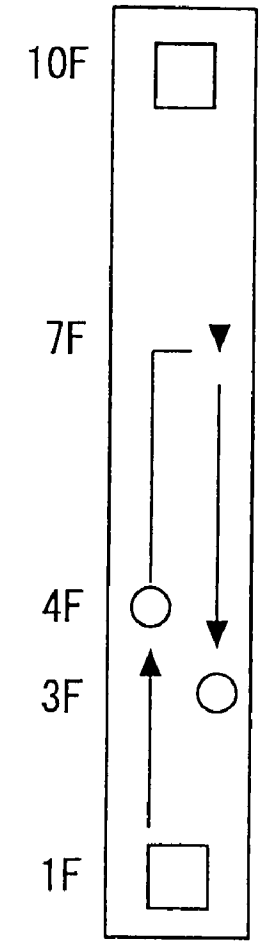

FIG. 1 is a block diagram showing the configuration of an elevator system provided with a group control apparatus in accordance with the present invention, FIG. 2 schematically shows a destination floor registration device placed at the elevator halls, FIG. 3 is a flowchart showing flows of control by the elevator group control apparatus of the present invention, and FIG. 4 is provided to explain how the elevator group control apparatus of the present invention calculates the travel ranges of cars and determines candidate cars.

A group control apparatus 1 in FIG. 1 efficiently controls a bank of plural elevators in an elevator system where each shaft has an upper car and lower car which can go up and down independently of each other. The group control apparatus 1 comprises: communicating means 1*a*, car travel range calculating means 1*b*, assignment candidate selecting means 1*c*, evaluation index calculating means 1*d*, assigning means 1*e* and operation control means 1*f*. The communicating means 1*a* communicates with each individual car control unit 2 which controls the operation of a car. If a new destination floor is entered from one of the destination floor registration devices 3 placed at the boarding halls where the upper or lower cars stop, the car travel range calculating means 1*b* provisionally assigns this new destination call to each car and calculates the travel range of the provisionally assigned car and the travel range of the other car in the same shaft. Based on the calculation result obtained by the car travel range calculating means 1*b*, the assignment candidate selecting means 1*c* selects candidate cars for assignment to the new destination call. For each candidate car selected by the assignment candidate selecting means 1*c*, the evaluation index calculating means 1*d* calculates several evaluation index values such as waiting time to evaluate the assignment of the candidate car to the new destination call. By comprehensively judging the calculation result obtained by the evaluation index calculating means 1*d*, the assigning means 1*e* finally determines which one of the candidate cars selected by the assignment candidate selecting means 1*c* is to be assigned to the new destination call. Based on the new destination call, the operation control means if controls the operation of the car determined to be assigned by the assigning means 1*e*. Each of these means 1*a* through 1*f* is implemented by software on a microcomputer. Each elevator hall is provided with a destination floor registration device 3 mentioned above and a hall lantern 4 by passengers are given guidance information about the expected arrival of a car to serve newly entered destination floor calls. The hall devices, including the destination floor registration device 3 and the hall lantern 4, are controlled by a hall station 5 which communicates with the communication means 1*a* in the group control apparatus 1 and the individual car control device 2.

As shown in FIG. 2, the destination floor registration device 3 installed at each elevator hall is provided with destination floor registration buttons 3*a* and response display panels 3*b*. The destination floor registration buttons 3*a* are used by passengers present at the hall to enter desired destination floors. Each of the display panels 3*b* is notification means to notify passengers present at the hall of a car which will arrive in response to the entered destination call or a hall at which a car will arrive in response to the call. Note that FIG. 2 shows that the fifth floor is registered as a destination floor by a passenger at the hall who wants to go to the fifth floor and car A will arrive at the hall in response to the newly entered destination call or a certain car will arrive at hall A in response to the call. This destination floor registration device 3 may be of any form if it is provided with a destination floor registration feature to allow passengers at the hall to enter a destination floor and a response notification feature to notify passengers of a car which will arrive in response to the entered destination call or a hall at which a car will arrive in response to the call.

Operation in accordance with the present invention is described below.

In FIG. 3, if a destination floor registration button 3*a* is pressed by an elevator user at some hall, the new destination call information is registered in the group control apparatus 1 via the communication means 1*a* (step S100). Upon registration of the new destination call, the car travel range calculating means 1*b* provisionally assigns this new destination call to one car (step S101) and calculates the travel range of the car to which the new destination call is provisionally assigned and the travel range of the other car in the shaft where the provisionally assigned car is also serving (step S102). Based on the result of calculation by the car travel range calculating means 1*b*, the assignment candidate selecting means 1*c* judges whether the provisionally assigned car is appropriate as a candidate for assignment (step S103). If judged not appropriate as a candidate for assignment, the car travel range calculating means 1*b* cancels the provisional assignment of the car to the new destination call (step S105).

Based on FIGS. 4(*a*)-(*c*), the following provides a detailed description of how the travel range of the car assigned to the new destination call is calculated (step S102) and the car is judged whether it is appropriate as a candidate for assignment (step S103).

Shown in FIG. 4(*a*), the lower car in a shaft is now going up across the first floor toward the fourth floor and the upper car is waiting at the tenth floor with the door closed. In this situation, if the destination floor registration button 3*a* for the third floor is pushed at the seventh floor's hall, a new destination call is registered with the third floor specified as the destination. Then, if the upper car in this shaft is provisionally assigned to the new destination call by the car travel range calculating means 1*b*, the travel range of the provisionally assigned upper car and the travel range of the lower car are calculated. According to this assignment, the upper car would go down from the tenth floor, stop at the seventh floor to take on passengers and go down again to carry the passengers to the third floor. Therefore, the third floor is calculated as the bottom of the upper car's travel range. Meanwhile, since the lower car is now going up toward the fourth floor, the fourth floor is calculated as the top of the lower car's travel range. This means that since the travel range of the upper car overlaps with the travel range of the lower car, collision may occur between the cars depending on the operational condition. Accordingly, the assignment candidate selecting means 1*c* excludes this upper car from a list of candidate cars which may be assigned to the new destination call. That is, the assignment candidate selecting means 1*c* judges a car to be a candidate for assignment to the new destination call only if the following equation (1) is met.

$$\text{(Bottom of Upper Car Travel Range)} > \text{(Top of Lower Car Travel Range)} \quad (1)$$

In FIG. 4(*c*), the lower car in the shaft is provisionally assigned to the new destination call by the car travel range calculating means 1*b*. In this case, the travel range of the upper car and the travel range of the lower car are calculated as below. After going up from the first floor to the fourth floor to serve the last destination call registered before the provisional assignment, the lower car would go up to the seventh floor to take on passengers there and then go down to the third floor. The seventh floor is calculated as the top of the lower car's travel range. Since the upper car would continue to wait at the tenth floor with the door closed, the tenth floor is calculated as the bottom of the upper car's travel range. In this case, since the travel range of the upper car does not overlap with the travel range of the lower car, that is, equation (1) is met, the assignment candidate selecting means 1*c* registers this lower car as a candidate for assignment to the new destination call. In FIG. 4, only one shaft is shown for the purpose simplification. In the case of a bank comprising a plurality of shafts, the above-mentioned travel range calculation and assignment candidate judgment are done for the upper and lower cars in each shaft.

Although the aforementioned assignment candidate judgment is done based merely on the bottom of the upper car's travel range and the top of the lower car's travel range, it is also possible to secure a safety distance between the bottom of the upper car's travel range and the top of the lower car's travel range. For example, although equation (1) is met if the fifth floor and fourth floor are calculated respectively as the bottom of the upper car's travel range and the top of the lower car's travel range, this may be considered dangerous since the upper and lower cars comes close to each other. Therefore, the assignment candidate selecting means 1*c* may be designed not to judge a car to be a candidate for assignment to the new destination call unless the following equation (2) is met.

$$\text{(Bottom of Upper Car Travel Range)} - \text{(Top of Lower Car Travel Range)} > \text{(Safety Distance)} \quad (2).$$

In this case, the safety distance may be either a fixed value such as one floor or two floors or a variable value determined based on the car's travel direction, speed, etc.

On the other hand, in FIG. 3, if the assignment candidate selecting means 1*c* judges the car to be a candidate for assignment to the new destination call, the evaluation index calculating means 1*d* calculates several evaluation index values including waiting time, travel time and crowding probability which are common in conventional group control systems (step S104). For example, if it is predicted that the upper car would arrive at the seventh floor ten seconds later and at the third floor 30 seconds later in FIG. 4(*b*), 10 seconds and 20 seconds are respectively calculated for the new destination call as the predicted wait time and travel time. These expected arrival times are determined from the car's speed and acceleration, the floor-to-floor distance, the floors at which the cargo would stop, etc. Calculation of these several evaluation values is not described in more detail here since this is widely employed by conventional group control systems. Upon completion of calculation of the evaluation index values by the evaluation index calculating means id, the provisional assignment of the car to the new destination call is cancelled by the car travel range calculating means 1*b* (step S105). This control sequence from the provisional assignment to the new destination call (step S101) to the cancellation of the provisional assignment (step S105) is performed for each car under group control of the group control apparatus 1. Each car is judged to be appropriate or not appropriate as a candidate for assignment to the new destination call. If judged appropriate, calculation of several evaluation index values is performed on the car. When the control sequence from the provisional assignment to the new destination call (step S101) to the cancellation of the provisional assignment (step S105) is complete for each car under group control, the assigning means 1*e* comprehensively evaluates the evaluation index values calculated by the evaluation index calculating means 1*d* and, based on the result, finally determines which of the candidate cars selected by the assignment candidate selecting means 1*c* is to be assigned to the new destination call (step S106). Various methods may be used to comprehensively evaluate the individual evaluation index values in determining which car to assign. For example, the following evaluation function may be used.

$$J(e)=\min J(I)$$

$$J(I)=S\ Wi\times fi(xi)$$

where, e: Assigned car, I∈Candidate-car, Wi: Weight and Xi: Individual evaluation value such as wait time.

Once a car to be assigned to the new destination call is finally determined by the assigning means 1*e*, the operation control means 1*f* controls the operation of this car based on the new destination call (step S110). In addition, information about this car assigned to the new destination call by the assigning means 1*e* is provided by such notice means as the response display panel 3*b* for the hall where the new destination call was entered.

INDUSTRIAL APPLICABILITY

As described in the foregoing, an elevator group control apparatus of the present invention can raise the general transportation efficiency of an elevator system while avoiding collision between the upper car and lower car which can go up and down independently of each other in the same shaft since if a new destination call is registered, each of the cars under group control is checked whether it would cause collision with the other car if assigned to the new destination call, the car is selected as a candidate for assignment to the new destination call if the car would cause no collision and from the thus selected candidates, an optimum car is finally selected for assignment to the new destination call.

The invention claimed is:

1. An elevator group control apparatus which controls an elevator system in which an upper car and a lower car serve in a single shaft and go up and down therein independently, comprising:

a destination floor registration device to register a destination floor, installed at each hall where the upper car or the lower car may stop;

car travel range calculating means for calculating travel range of a car assigned provisionally to a destination call registered by the destination floor registration device and travel range of the other car in the shaft where the provisionally assigned car serves;

assignment candidate selecting means for selecting a car as a candidate for assignment to a destination call, based on a calculation by the car travel range calculating means;

evaluation index calculating means for calculating an evaluation value for each of the cars selected as candidates for assignment to the destination call by the assignment candidate selecting means;

assigning means for finally determining which of the candidates is to be assigned to the destination call, based on a calculation by the evaluation index calculating means; and operation control means for control by operation of the car assigned, based on the destination call registered.

2. The elevator group control apparatus according to claim 1, wherein the assignment candidate selecting means selects a car as a candidate for assignment to a destination call based on bottom of the travel range of the upper car calculated by the car travel range calculating means and top of the travel range of the lower car calculated by the car travel range calculating means.

3. The elevator group control apparatus according to claim 1, wherein the assignment candidate selecting means selects or rejects a car as a candidate for assignment to a destination call based on bottom of the travel range of the upper car calculated by the car travel range calculating means, top of the travel range of the lower car calculated by the car travel range calculating means, and a safety distance assumed between the upper car and the lower car.

4. The elevator group control apparatus according to claim 1, further comprising notice means by which information about a car assigned by the assigning means is reported to the hall where the destination floor was entered.

5. The elevator group control apparatus according to claim 2, further comprising notice means by which information about a car assigned by the assigning means is reported to the hall where the destination floor was entered.

6. The elevator group control apparatus according to claim 3, further comprising notice means by which information about a car assigned by the assigning means is reported to the hall where the destination floor was entered.

* * * * *